United States Patent [19]

Bunnell

[11] 4,369,682

[45] Jan. 25, 1983

[54] ROTARY DIE CUTTERS HAVING MAGNETICALLY-ATTRACTED WASTE EJECTOR

[75] Inventor: Thomas K. Bunnell, Prestbury, England

[73] Assignee: Dolan Corrugated Containers Limited, Stalybridge, England

[21] Appl. No.: 230,184

[22] Filed: Jan. 30, 1981

[30] Foreign Application Priority Data

Feb. 23, 1980 [GB] United Kingdom ..... 8006211

[51] Int. Cl.[3] ..... B21D 45/04

[52] U.S. Cl. ..... 83/112; 83/116; 83/123

[58] Field of Search ..... 83/109, 111, 112, 113, 83/115, 116, 117, 123–124, 128, 136, 141, 151, 153, 154

[56] References Cited

U.S. PATENT DOCUMENTS

| | | | |
|---|---|---|---|
| 948,382 | 2/1910 | Scott et al. | 83/151 X |
| 2,496,468 | 2/1950 | Hanson | 83/116 |
| 2,976,753 | 3/1961 | Fowler et al. | 83/112 X |
| 2,992,580 | 7/1961 | Stolk et al. | 83/136 |
| 4,224,851 | 9/1980 | Imai | 83/117 |

FOREIGN PATENT DOCUMENTS

| | | | |
|---|---|---|---|
| 590094 | 2/1978 | U.S.S.R. | 83/111 |

*Primary Examiner*—James M. Meister

*Attorney, Agent, or Firm*—Sughrue, Rothwell, Mion, Zinn, Macpeak and Seas

[57] ABSTRACT

A rotary die cutter comprises a rotary soft anvil coacting with a rotary hard anvil mounting one or more cutting rules, or forms. Each cutting rule has within the area defined by the rule a metal or metal-containing pusher adapted to be moved radially outwardly of the rule at a predetermined location by a magnetic source to eject from the rule any cut waste board contained therein.

2 Claims, 3 Drawing Figures

ROTARY DIE CUTTERS HAVING MAGNETICALLY-ATTRACTED WASTE EJECTOR

BACKGROUND OF THE INVENTION

This invention relates to rotary die cutters.

It is necessary with rotary die cutters to provide a means whereby the cut waste is ejected from the cutting rules at a predetermined location since if it is not ejected, or only partially ejected, from a cutting rule then on the next occasion on which that cutting rule is required to effect a cutting action it will either fail to penetrate the board or will only partially do so, resulting in waste and possibly machine downtime.

As is well known to those skilled in the art a rotary die cutter generally comprises a rotary soft anvil and a rotary hard anvil, both of cylindrical form and driven in counter-rotation to assist movement of board to be cut therebetween. Cutting rules are mounted on the cylindrical surface of the hard anvil in an arrangement predetermined by the required final configuration of board. A known means of ensuring ejection of cut waste board out of the cutting rules comprises a series of rods disposed inside the cutting forme, which has an eccentrically-located roller housed therein with the cylindrical surface of the anvil being traversed by an array of holes through which the rods extend when acted upon by the eccentric roller.

With this construction, when the arrangement of cutting rules is set up on the exterior cylindrical surface of the hard anvil it is then necessary to provide an arrangement of the rods within the hard anvil to act within the areas defined by the cutting rules due to the presence of the eccentric roller so that they move outwardly of the cutting forme to eject cut waste board out of the rules only at a predetermined location. The inner ends of the rods are, of course, restrained into contact with the surface of the eccentric roller.

It will be manifest that such a cutting forme is relatively expensive to provide, requires a skilled operator to set up, and involves considerable setting-up time with consequent machine downtime.

SUMMARY OF THE INVENTION

It is an object of the present invention to obviate or mitigate the aforesaid drawbacks.

According to the present invention there is provided a rotary die cutter having a cutting rule and within the area defined by the cutting rule a magnetically-operable pusher.

The rotary die cutter more specifically may comprise a rotary soft anvil coacting with a rotary hard anvil mounting one or more cutting rules, or formes, each having within the area defined by the rule a metal or metal-containing pusher adapted to be moved radially outwardly of the rule at a predetermined location by a magnetic source to eject from the rule any cut waste board contained therein.

Preferably the rotary die cutter is disposed above a waste-removal conveyor below the upper run of which is disposed a permanent magnet or electromagnet.

BRIEF DESCRIPTION OF THE DRAWINGS

An embodiment of the present invention will now be described, by way of example, with reference to the accompanying diagrammatic drawing, in which.

DETAILED DESCRIPTION OF THE PREFERRED EMBODIMENT

Figure 2:
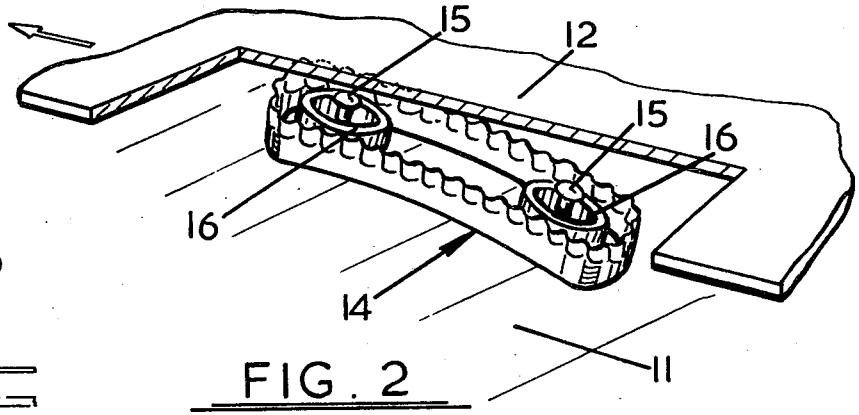
FIG. 2 is a fragmentary diagrammatic view showing a cutting rule in cutting position, the board being cut away in exaggerated manner to show the cutting rule more clearly.
Figure 3:
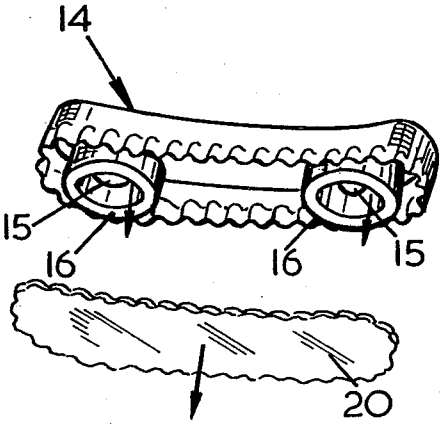
FIG. 3 is a perspective view of the cutting rule in the waste board-ejecting position.
Figure 1:
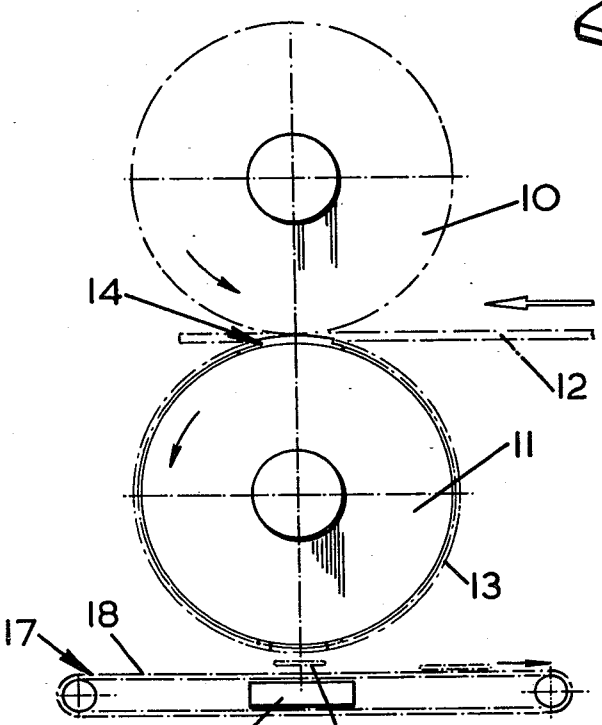
FIG. 1 is a diagrammatic side elevation of a rotary die cutter according to the invention.

The rotary die cutter comprises, as is customary, an upper rotatable cylindrical anvil 10, whereof the circumference is covered with a soft elastomeric material, for example polyurethane, and a lower rotatable cylindrical hard anvil 11 (a metal anvil). These anvils 10 and 11 rotate in counter-directions as indicated to feed board 12 to be cut therebetween.

On the outer circumference of the hard anvil 11 are secured formers generally indicated at 13 and these formers mount cutting rules (one indicated at 14) in predetermined arrangement and which serve, as is well known, to cut out areas of the board 12 due to anvil inter-action.

The present invention is concerned primarily with the means for ejecting the cut waste board, and one example is shown. In this example, within the area defined by the rule 14 there is provided two headed pins 15 of less depth than the wall of the rule 14, i.e. they do not protrude beyond the cutting edge of the rule 14, and therefore do not interfere with the cutting action of the latter. Each pin 15 supports a metal pusher 16 in the form of a button and movable along the pin 15 but restrained from leaving the latter by the pin head. The depth of the pusher 16 is such that, when the pin 15 is depending downwardly from the hard anvil 11, the pusher 16 protrudes out of the cutting rule 14.

Below the rotary die cutter is a waste removal conveyor 17 below the upper run 18 of which is a magnetic source 19, permanent magnet or electromagnet.

In use, the cutting rule 14 at the anvil nip cuts a piece 20 out of the board 12 and this waste piece 20 of board is carried round by the hard anvil 11 within the rule 14 until the influence of the magnetic source 19 acts on the pushers 16 pulling them radially outwards of the rule 14 to eject the waste board piece 20 onto the conveyor 17. Movement of the rule 14 away from the waste conveyor 17 releases the pushers 16 from the influence of the magnetic source 19.

Many variations of rule construction are possible provided each construction involves within the rule area a magnetically operable pusher for waste board ejection.

What is claimed is:

1. A rotary die cutter, comprising: an upper rotary anvil, a lower rotary anvil defining with the upper rotary anvil a nip through which board to be cut can be passed, at least one cutting rule mounted on the circumference of the lower rotary anvil and defining an area adapted to be cut in a board by the rule, a metallic pusher supported within the area defined by the cutting rule for movement radially of the lower rotary anvil whereat it protrudes outwardly of the cutting rule to eject any cut waste board contained within the cutting rule, a waste-removal conveyor disposed below the lower rotary anvil, and magnetic means disposed below an upper run of the conveyor to attract the pusher as its associated cutting rule passes the conveyor and cause the pusher to move radially outwards and eject the cut waste board.

2. A rotary die cutter as claimed in claim 1, comprising within the area defined by the cutting rule a pin including a stem secured to the lower rotary anvil circumference and a head remote from said anvil circumference, said pin being of less depth than a wall of the cutting rule, and said pusher being in the form of a metal button carried by the stem for axial movement therealong, the metal button being prevented from axial disengagement from the pin by the head thereof.

* * * * *